United States Patent [19]

Aoki

[11] 4,070,942

[45] Jan. 31, 1978

[54] TONE GENERATOR

[75] Inventor: Eiichiro Aoki, Hamamatsu, Japan

[73] Assignee: Nippon Gakki Seizo Kabushiki Kaisha, Hammamatsu, Japan

[21] Appl. No.: 748,969

[22] Filed: Dec. 9, 1976

[30] Foreign Application Priority Data

| | | |
|---|---|---|
| Dec. 11, 1975 | Japan | 50-148065 |
| Dec. 11, 1975 | Japan | 50-148066 |
| Dec. 11, 1975 | Japan | 50-148067 |

[51] Int. Cl.[2] ..... G10H 1/00

[52] U.S. Cl. ..... 84/1.01; 84/1.24

[58] Field of Search ..... 84/1.01, 1.03, 1.24, 84/1.25

[56] References Cited

U.S. PATENT DOCUMENTS

| | | | |
|---|---|---|---|
| 3,878,750 | 4/1975 | Kapps | 84/1.01 |
| 3,895,554 | 7/1975 | Maillet | 84/11.5 |
| 3,977,290 | 8/1976 | Sakashita | 84/1.01 |
| 3,979,996 | 9/1976 | Tomisawa et al. | 84/1.25 |
| 4,023,454 | 5/1977 | Obayashi et al. | 84/1.01 |
| 4,043,240 | 8/1977 | Ando | 84/1.01 |

*Primary Examiner*—Robert K. Schaefer
*Assistant Examiner*—Vit W. Miska
*Attorney, Agent, or Firm*—Spensley, Horn & Lubitz

[57] ABSTRACT

A tone generator for an electronic musical instrument. In the tone generator, a coincidence output is produced when contents of a counter which successively counts a clock pulse have amounted to a value representing a tone of a depressed key. The counter is reset by a reset pulse with delay of a predetermined clock time from the time when the coincidence output is produced.

An example is disclosed in which an output of a desired period is statically produced by generating the reset pulse with delay of selected number of clock pulses with respect to the coincidence output. Also disclosed is another example in which desired signals among a plurality of delayed signals produced with delay of one or more clock pulses with respect to the coincidence output are dynamically selected for resetting the counter in response to an output of another counter which cyclically performs counting.

6 Claims, 15 Drawing Figures

TONE GENERATOR

BACKGROUND OF THE INVENTION

This invention relates to a tone generator used in an electronic musical instrument.

There is a prior art digital type tone generator which uses a variable frequency dividing circuit such as disclosed in U.S. Pat. No. 3,824,397 specification. In this type of tone generator, variable adjustment of the pitch of a frequency divided output (i.e., a generated tone) is made by varying the frequency of a master clock pulse. For this purpose, the oscillation frequency of a master clock pulse oscillator is variably controlled by adjusting resistance value of a variable resistor or the like. This method of adjustment, however, is found to have a disadvantage of adversely affecting stability and accuracy of the frequency.

If it is desired to impart a vibrato effect to the generated tone, such vibrato effect can be produced by changing the master clock pulse frequency by a vibrato frequency. It is, however, difficult to change the master clock pulse frequency which is produced at a high rate in the order of 2MHz without impairing stability of the frequency.

SUMMARY OF THE INVENTION

It is, therefore, an object of the present invention to provide a tone generator of an electronic musical instrument capable of effecting a static pitch adjustment of a generated tone (i.e., frequency divided output) and a dynamic pitch variation control (including a vibrato control) without changing the frequency of the master clock pulse.

It is another object of the invention to provide a tone generator capable of selectively controlling the depth of vibrato imparted to the generated tone.

It is another object of the invention to provide a tone generator capable of providing the vibrato depth asymetrically with respect to frequency ($fc/m$).

It is still another object of the invention to provide a tone generator capable of producing a delay vibrato effect which increases in the vibrato depth as time elapses after depression of the key.

These and other objects and features of the invention will become apparent from the description made hereinbelow with reference to the accompanying drawings.

DESCRIPTION OF THE PREFERRED EMBODIMENTS

Figure 1:
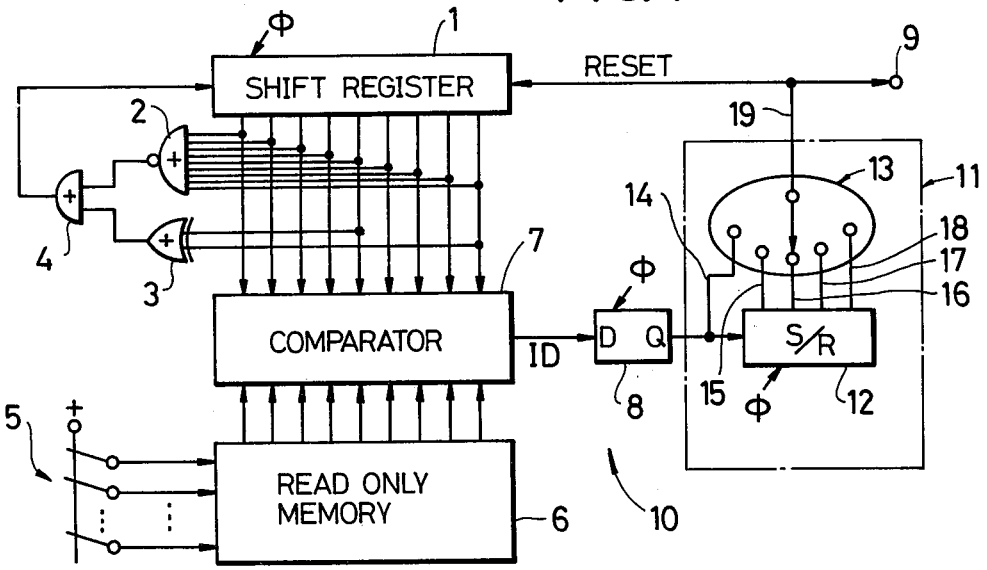
FIG. 1 is a block diagram showing a preferred embodiment of the tone generator according to the invention in which the pitch can be adjusted by an operation of a switch.

Referring first to FIG. 1, one example of the tone generator embodying the invention will be described. In FIG. 1, the tone generator is illustrated in which, for convenience of explanation, a variably adjustable delay device 11 is provided and the output of a delay flip-flop 8 is directly connected to a reset input of a shift register 1 and an output terminal 9.

In a digital type tone generator, a maximum period counter composed of a shift register 1, a NOR circuit 2, an exclusive OR circuit 3 and an OR circuit 4 is driven by a master clock pulse $\phi$. A digital numerical valve signal corresponding to a tone selected by a keyboard switch circuit 5 is read from a read-only memory 6 and this digital numerical value signal is compared with the content of the maximum period counter (i.e. parallel outputs of the shift register 1) in a comparator 7. When there is coincidence between the digital numerical value and the content of the counter, the shift register 1 is reset. The coincidence detection output of the comparator 7 is delayed by one bit time by the delay flip-flop 8 and thereafter is applied to the shift register 1 as a reset signal and also is utilized as an output signal of the tone generator, i.e., a frequency signal for a tone selected by the keyboard switch circuit 5. The one-bit delay flip-flop 8 serves as a buffer circuit for preventing an erroneous operation which could be caused by a slight delay which would occur if an arrangement was made to reset the shift register immediately upon detection of the coincidence in the comparator 7.

An operation for frequency-dividing the master clock pulse $\phi$ in the digital type tone generator will now be described briefly. If a desired tone is selected by the keyboard switch circuit 5, a digital numerical value signal corresponding to the tone is read from the read-only memory 6. On the other hand, the contents of the parallel outputs of the shift register 1 change at every application of the master clock pulse $\phi$. Assume that the coincidence is detected in the comparator 7 when $n$ shots of the clock pulse $\phi$ have been applied to the shift register counting from a state in which the contents of the parallel outputs of the shift register 1 are all "0". Then the shift register 1 will receive a reset signal whenever $n + 1$ shots of the clock pulse $\phi$ have been produced. Accordingly, the frequency of the frequency divided output delivered out of the output terminal 9 is $(1/(n + 1)$ of the frequency of the master clock pulse $\phi$. This frequency divided output corresponds to the frequency of the tone selected by the keyboard switch circuit 5.

Assume, for example, that the shift register 1 consists of 9 bits with the fifth bit and the ninth bit connected to the exclusive OR circuit 3 as shown in FIG. 1. The content of the shift register 1 changes as shown in the following Table I as the pulse $\phi$ is successively applied to the shift register 1.

Table 1

| No. of pulse $\phi$ | content of shift register 1 | | | | | | | | |
|---|---|---|---|---|---|---|---|---|---|
| reset | 0 | 0 | 0 | 0 | 0 | 0 | 0 | 0 | 0 |
| 1 | 1 | 0 | 0 | 0 | 0 | 0 | 0 | 0 | 0 |
| 2 | 0 | 1 | 0 | 0 | 0 | 0 | 0 | 0 | 0 |
| 3 | 0 | 0 | 1 | 0 | 0 | 0 | 0 | 0 | 0 |
| 4 | 0 | 0 | 0 | 1 | 0 | 0 | 0 | 0 | 0 |
| 5 | 0 | 0 | 0 | 0 | 1 | 0 | 0 | 0 | 0 |
| 6 | 1 | 0 | 0 | 0 | 0 | 1 | 0 | 0 | 0 |
| 7 | 0 | 1 | 0 | 0 | 0 | 0 | 1 | 0 | 0 |
| . | | | | | . | | | | |
| . | | | | | . | | | | |
| . | | | | | . | | | | |

If the content of the digital signal read from the read-only memory 6 in accordance with selection by the keyboard switch circuit 5 is, for example, 100001000, this content coincides with the sixth content of Table I. Accordingly, as six shots of the pulse $\phi$ have been applied to the shift register 1, the coincidence output ID of the comparator 7 becomes "1" and the shift register 1 is reset one clock pulse later. In this case, a frequency signal obtained by frequency-dividing the master clock pulse $\phi$ by seven is outputted from the output terminal 9. Thus, a frequency signal of a desired pitch is obtained.

The foregoing description has been made with reference to a case where the output of the delay flip-flop is directly connected to the line 19. The tone generator according to the present invention, however, comprises a variably adjustable delay device 11 as shown in FIG. 1. Description will now be made about this delay device 11.

The variably adjustable delay device 11 inserted between the delay flip-flop 8 and the reset input of the shift register 1 includes a shift register 12 and a rotary switch 13. The shift register 12 of suitable stages e.g. 4 stages, receives the output of the delay flip-flop 8 provided as a buffer and successively shifts it at the rate of the master clock pulse $\phi$, producing an output sequentially from output lines 15, 16, 17 and 18 of respective stages with one clock time interval. The rotary switch 13 is connected to an output line 14 and selected one of the output lines 15 - 18 of the shift register 12. A signal from a common output line 19 of the switch 13 is applied to the reset input of the shift register 1 as the reset signal and also is used as the output frequency signal of the tone generator 10.

The signals of the output lines 14–18 applied to the rotary switch 13 are sequentially delayed from the timing of the coincidence detection signal ID produced by the comparator with a delay time which sequentially increases by one clock time. Assuming that the content of the shift register 1 (e.g. 9 stages) constructed as the maximum period counter coincides with the content of the digital signal (likewise 9 bits fread from the read-only memory 6 in accordance with selection in the keyboard switch circuit 5 when $n$ shots of the master clock pulse $\phi$ have been counted from the state in which the content of the shift register 1 is all "0", the output of the line 14 is "1" when $n + 1$ shots of the pulse $\phi$ have been counted and the output of the line 15 is "1" when $n + 2$ shots of the pulse $\phi$ have been counted. Likewise, the output of the line 16 is "1" when $n + 3$ shots have been counted, the output of the line 17 is "1" when $n + 4$ shots have been counted and the output of the line 18 is "1" when $n + 5$ shots have been counted. Accordingly, if the rotary switch 13 is connected to the line 14 as shown in Table II, Column A, the frequency dividing ratio becomes $(1)/(n + 1)$. Subsequent frequency dividing ratios are as shown in Table II.

Table II

| | $n + 3 = m$ | |
|---|---|---|
| | A | B |
| connecting position of switch 13 | frequency dividing ratio | frequency divided output (Hz) |
| line 14 | 1 | fc |
| | n + 1 | m − 2 |
| line 15 | 1 | fc |
| | n + 2 | m − 1 |
| line 16 | 1 | fc |
| | n + 3 | m |
| line 17 | 1 | fc |
| | n + 4 | m + 1 |
| line 18 | 1 | fc |
| | n + 5 | m + 2 |

As will be apparent from Table II, Column A, the respective connecting positions of the switch 13 (i.e. times 14 - 18) correspond to the difficult frequency dividing ratios and, accordingly, the frequency dividing ratio can be varied by switching the connecting position of the switch 13. If the frequency dividing ratio of the line 16 is taken as reference under a condition $n + 3 = m$, the frequency dividing ratios of the lines 14 - 18 can be expressed respectively as $(1/(m - 2)$, $1/(m - 1)$, $(1/m)$, $1/(m + 1)$ and $1/(m + 2)$. The digital signal read from the read-only memory 6 is set at such a value that the frequency divided output $fc/m$[Hz] (where fc represents the frequency of the master clock pulse $\phi$) obtained from the output terminal 9 becomes a normal pitch when the switch 13 is connected to the line 16. The frequency divided outputs when the switch 13 is connected to the lines 14 - 18 are shown in Table II, Column B. Table II shows that a pitch higher than the normal pitch is obtained if the switch 13 is connected to the line 14 or 15, whereas a pitch lower than the normal pitch is obtained if the switch 13 is connected to the line 17 or 18.

It will be understood from the foregoing description that the pitch adjustment can be made simply by switching the position of the switch 13 without charging the frequency of the master clock pulse $\phi$. In a case where a plurality of switches are selected in the keyboard switch circuit 5, a priority circuit is normally provided between the keyboard switch circuit 5 and the read-only memory 6. Description of the priority circuit, however, will be omitted for it is not related to the subject matter of the present invention. If it is desired to adjust the pitch of each note of the chromatic scale, the tone generator 10 which is of the same construction as the one shown in FIG. 1 may be provided for each of tones C, C sharp . . . B and the position of the rotary switch 13 may be adjusted for each of the tone generators. Further, the counter in the tone generator 10 is not limited to the above described maximum period counter which consists of the shift register 1, the NOR circuit 2, the exclusive OR circuit 3 and the OR circuit 4 but other general counting devices may be employed.

Figure 2:
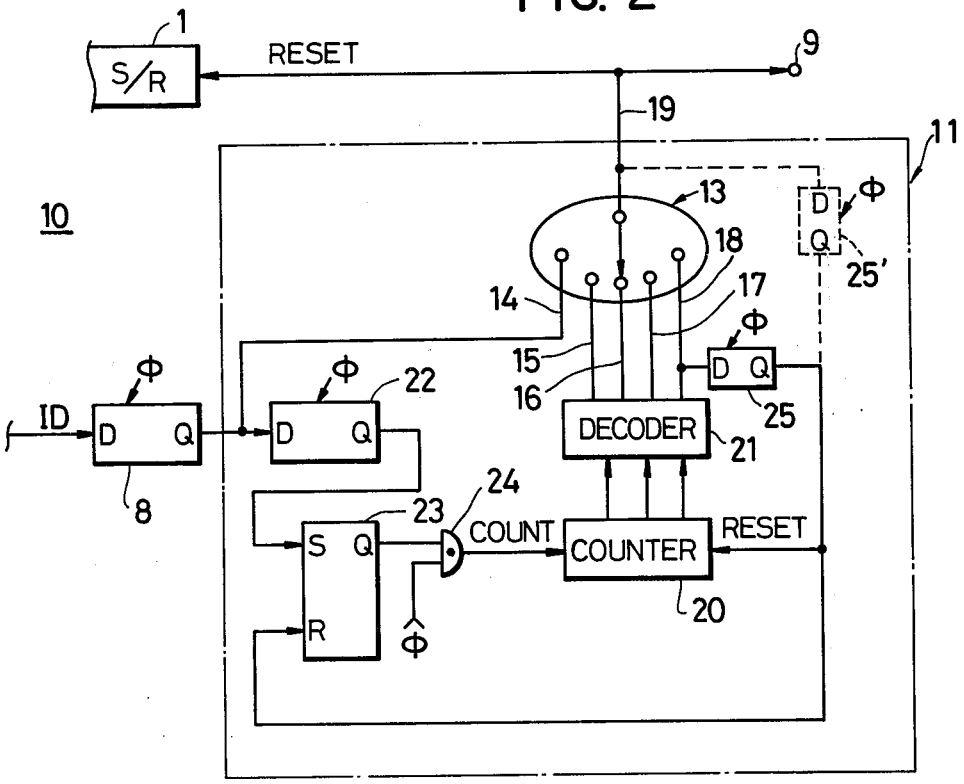
FIG. 2 is a block diagram showing another example of a variably adjustable delay device shown in FIG. 1.
Figure 3:
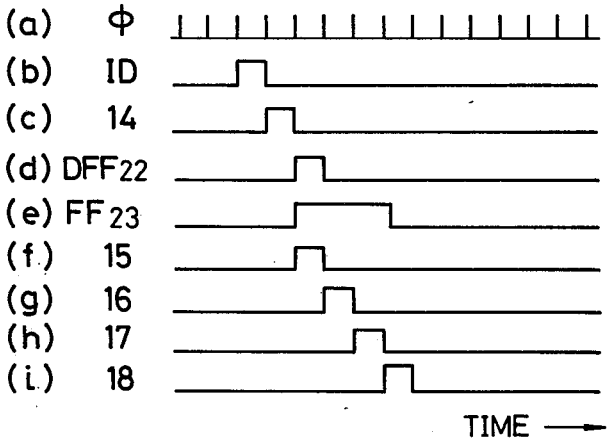
FIGS. 3(*a*) through 3(*i*) are timing charts illustrative of outputs of component parts of the variable delay device shown in FIG. 2.

FIG. 2 shows another example of the variably adjustable delay device 11 in which illustration of the NOR circuit 2, the exclusive OR circuit 3, the OR circuit 4, the keyboard switch circuit 5, the read-only memory 6 and the comparator 7 is omitted for convenience of description. In FIG. 2 a counter 20 of at least three bits and a decoder 21 are used instead of the shift register 12. The output of the delay flip-flop 8 provided for a buffer purpose is connected to the line 14 of the rotary switch 13 whereas four outputs of the decoder 21 are connected to the lines 15 - 18 of the switch 13. In the timing charts of FIG. 3, (*a*) shows the master clock pulse $\phi$ and (*b*) the coincidence detection ouput ID of the comparator 7 (FIG. 1). The coincidence detection output ID is delayed by one clock in the delay flip-flop 8 and is supplied to the line 14 (FIG. 3(*c*)). The output of the delay flip-flop 8 is further delayed by one clock in a delay flip-flop 22 (FIG. 3(*d*)) and is used to set a flip-flop 23 (FIG. 3(*e*)). As the flip-flop 23 is set, the AND circuit 24 is enabled to pass the master clock pulse $\phi$ to the counting input of the counter 20 via an AND circuit 24. The counter 20 counts the master clock pulse $\phi$ only while the flip-flop 23 is set. The decoder 21 decodes the counting content of the counter 20 and thereupon produces a pulse sequentially on each of the lines 15–18 (FIG. 3(*f*)–FIG. (*i*)). The signal "1" on the line 18 is delayed by one clock in the delay flip-flop 25 and thereafter is used for resetting the counter 20 and the flip-flop 23. The signal on the output line 19 may be used as the signal for resetting the counter 20 and the flip-flop 23 as indicated by a dotted line instead of the signal on the output line 18. As shown in FIGS. 3(*c*), 3(*f*), 3(*g*), 3(*h*) and 3(*i*), the signal on the line 14 applied to the rotary switch 13 is delayed by one clock from the timing of the coincidence detection output ID of the comparator 7(FIG. 2), the signal on the line 15 is delayed by one clock from the signal 14 and each of the signals on the lines 16, 17 and 18 is likewise delayed by one clock from the signal on the line of an immediately preceding reference numeral. Thus, frequency dividing ratios similar to those shown in Table II can be selected as desired by means of the switch 13 and the pitch adjustment is thereby achieved.

Figure 4:
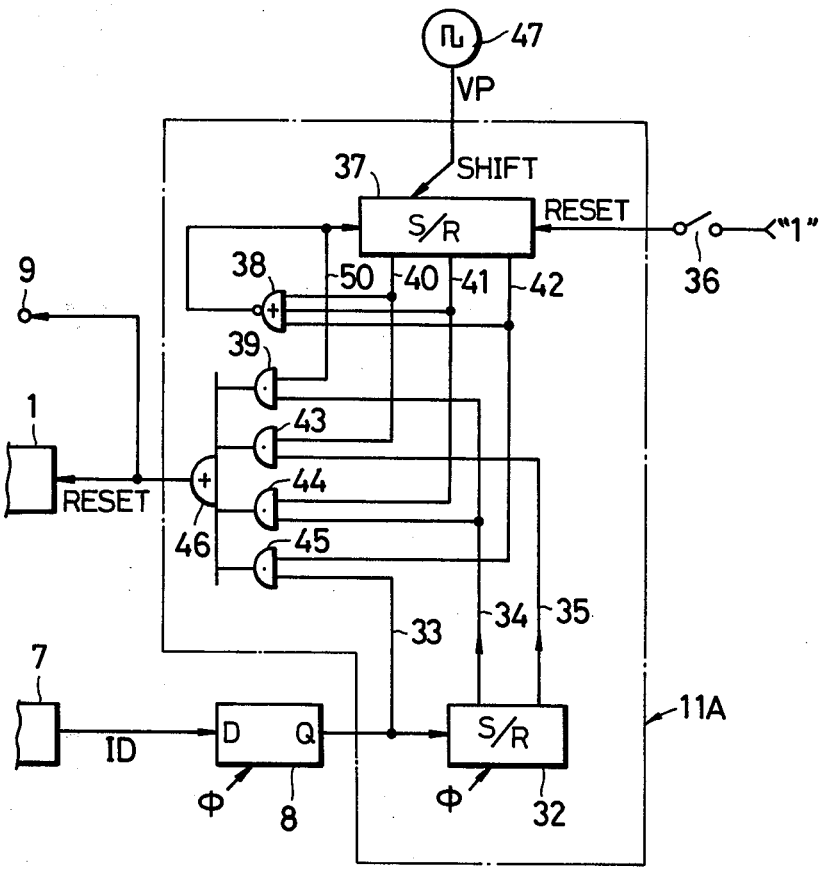
FIG. 4 is a block diagram showing another embodiment of the pitch control device of the tone generator according to the invention which is capable of providing the generated tone with a vibrato effect.

FIG. 4 shows the other embodiment of the tone generator according to the invention which is capable of producing a vibrato effect. Throughout FIGS. 1 and 4, the same component parts are designated by the same reference numerals and description of operations of these component parts in FIG. 4 will be omitted for avoiding redundancy.

A vibrato imparting device 11A inserted between the delay flip-flop 8 and the reset input of the shift register 1 comprises a shift register 32 for delaying the coincidence detection output ID of the comparator 7(the output of the delay flip-flop 8) in several steps and a circuit for sequentially and repeatedly selecting the delayed output at each of such steps and supplying it to the reset input of the shift register 1.

The shift register 32 consisting of a suitable number of stages e.g., two, sequentially shifts the output of the delay flip-flop 8 in accordance with the master clock pulse $\phi$ and produces a delayed output successively on lines 34 and 35. Accordingly, signals on a line 33 connected to the output of the delay flip-flop 8 and output lines 34 and 35 of the shift register 32 appear one after another with delay of one bit time. Assume that coincidence of content (e.g. 9 bits) of the shift register 1 (i.e. counter) with the content of the digital signal read from the read-only memory 6 is detected when $n$ shots of the master clock pulse $\phi$ counting from a state in which the content of the shift register 1 is all "0" have been applied to the shift register 1. The output of the line 33 when $n + 1$ shot of the pulse $\phi$ have been counted by the shift register 1 (counter) is "1", the output of the line 34 is "1" when $n + 2$ shots have been counted and the output of the line 35 is "1" when $n + 3$ shots have been counted. In the above described case where the signals on the lines 33, 34 and 35 are used as the reset signals for the shift register 1, frequency dividing ratios in the tone generator 10 are as shown in Table III.

Table III

| | A | $n + 2 = m$ B |
|---|---|---|
| | frequency dividing ratio | frequency divided output(Hz) |
| line 33 | $\frac{1}{n+1}$ | $\frac{fc}{m-1}$ |
| line 34 | $\frac{1}{n+2}$ | $\frac{fc}{m}$ |
| line 35 | $\frac{1}{n+3}$ | $\frac{fc}{m+1}$ |

As will be apparent from Table III, Column A, the signals on the lines 33, 34 and 35 which differ in the delay time from each other correspond to the different frequency dividing ratios. Accordingly, the frequency divided output changes depending upon which signal of the lines 33 - 35 is used as the reset signal. If, for example, the frequency divided output obtained when the signal on the line 34 is used as the reset signal is taken as a reference frequency $fc/m$ (where fc represents the frequency of the master clock pulse $\phi$) under a condition $m = n + 2$, the frequency divided outputs on the lines 33 - 35 becomes $fc/(m - 1)$, $fc/m$ and $fc/m + 1$ as shown in Table III, Column B. The frequency divided output $fc/(m - 1)$ obtained from the output terminal 9 when the signal on the line 33 is used as the reset signal is higher than the reference frequency $fc/m$, whereas the frequency divided output $fc/m + 1$ obtained when the signal on the line 35 is used as the reset signal is lower than the reference frequency $fc/m$. The content of the digital numerical value read from the read-only memory 6 is set at such a value that the reference frequency divided output $fc/m$ (Hz) is equivalent to the normal pitch of a tone selected by the keyboard switch circuit 5.

If the vibrato switch 36 is closed, a signal "1" is applied to the reset input of the shift register 37 to reset the content thereof. When the output of the shift register 37 becomes all "0", the output of a NOR circuit 38 becomes a signal "1" and, accordingly, an AND circuit 39 is enabled. Since AND circuits 43, 44 and 45 to which output lines 40, 41 and 42 of the 3 stage shift register 37 are connected are not enabled, the signal on the line 34 only is applied to the reset input of the shift register 1 vai the AND circuit 39 and an OR circuit 46. In this case the reference frequency divided output $fc/m$ only is obtained and no vibrato effect is produced.

If the vibrato effect is desired, the vibrato switch 36 is switched off as shown in FIG. 4. In this case, the shift register 37 is not reset but successively shifts the signal "1" supplied from the NOR circuit 38 in accordance with a pulse VP produced by a vibrato oscillator 47, providing a signal "1" sequentially on the lines 40, 41 and 42. When all of the output on the lines 40 - 42 become "0", the output of the NOR circuit 38 becomes "1" again, which signal "1". is applied to the shift register 37. Thus, the signals on line 50 (the output of the NOR circuit 38) and lines 40, 41 and 42 become "1" repeatedly and sequentially with the result that the AND circuits 39, 43, 44 and 45 are repeatedly enabled. The signal on the line 34 first becomes the reset signal for the shift register 1 by enabling of the AND circuit 39. Nextly, the signal on the line 35 becomes the reset signal by enabling of the AND circuit 43. Subsequently, the signals on the lines 34 and 33 become the reset signal, one after another, by sequential enabling of the AND circuit 44 and 45. Accordingly, the delay line used for supplying the reset signal to the shift register 1 cyclically changes line 34 - 35 34 - 33 with the result that the frequency of the frequency divided output periodically changes in the order of $fc/m$, $fc/m + 1$, $fc/m$, $fc/m - 1$ returning to the initial $fc/m$ and subsequently repeating the change in the same order. As the pitch cyclically changes increasingly and decreasingly with respect to the normal pitch $fc/m$, a vibrato effect is produced. Since one cycle of the change of the frequency divided output (changing in four states) constitutes a vibrato cycle, the frequency of the oscillated pulse VP from the vibrato oscillator is set at 28 Hz for example, if vibrato of 7Hz is desired. Accordingly, the AND circuits 39, 43, 44 and 45 are enabled in turn at a rate of 28 Hz. Generally speaking, the rate at which a signal "1" appears on the line 33, 34 or 35 (i.e., the pitch of the generated tone) is higher than the above described rate.

The shift registers 32 and 37 may be constructed of a suitable type of counter or decoder. Further, the number of stages of these shift registers 32 and 37 may be suitably increased.

Figure 5:
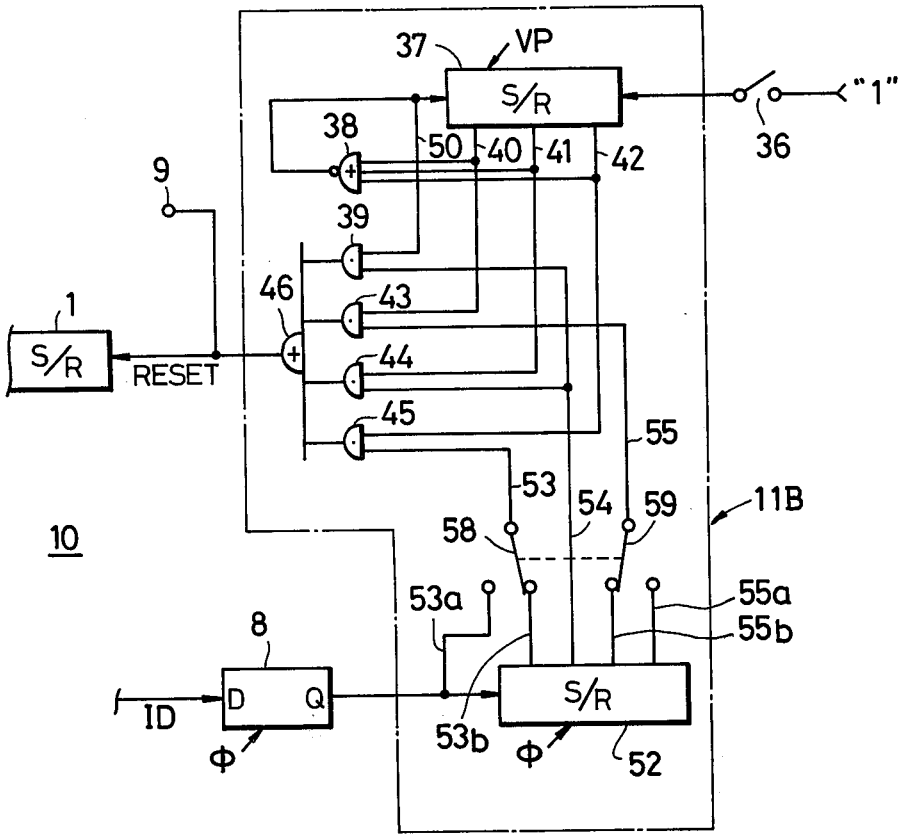
FIG. 5 is a block diagram showing a modified example of the pitch control device shown in FIG. 4 which is capable of changing the vibrato depth by operation of a selection switch.

FIG. 5 shows the embodiment of the tone generator according to the invention which is capable of variably adjusting the vibrato depth. In FIG. 5, only a circuit portion related to a vibrato imparting circuit 11B is illustrated and the other circuit portion which is substantially the same as the corresponding circuit portion shown in FIG. 4 is omitted. In the vibrato imparting circuit 11B, the output of the delay flip-flop 8 is applied to a 4-stage shift register 52 and shifted therein in accordance with the master clock pulse $\phi$. Signals on an output line 53*a* of the delay flip-flop 8 and output lines 53*b*, 54, 55*b* and 55*a* of the respective stages of the shift register 52 appear in turns with a delay of one bit time from each preceding signal. Accordingly, assuming that the signals on the lines 53*a*, 53*b*, 54, 55*a* are used as the reset signal for the shift register 1 (FIG. 4), frequency dividing ratios as shown in the following Table IV, Column A are produced. Frequency divided outputs in this case are as shown in Table IV, Column B with the line 54 being taken as a reference frequency and under a condition $n + 3 = m$.

Table IV

| reset signal | A frequency dividing ratio | $n + 3 = m$ B frequency divided output (Hz) |
|---|---|---|
| line 53a | $\frac{1}{n+1}$ | $\frac{fc}{m-2}$ |
| line 53b | $\frac{1}{n+2}$ | $\frac{fc}{m-1}$ |
| line 54 | $\frac{1}{n+3}$ | $\frac{fc}{m}$ |
| line55b | $\frac{1}{n+3}$ | $\frac{fc}{m+1}$ |
| line 55a | $\frac{1}{n+5}$ | $\frac{fc}{m+2}$ |

As will be apparent from Table IV, Column B, the frequency divided output on the line 53*a* is higher in frequency than the output on the line 53*b* and the frequency divided output on the line 55*a* is lower than the output on the line 55*b*. Accordingly, the vibrato depth is moderate when vibrato is imparted by combination of the lines 53*b*, 54 and 55*b*, whereas the vibrato depth is deep when vibrato is imparted by combination of the line 53*a*, 54 and 55*a*.

Figure 6:
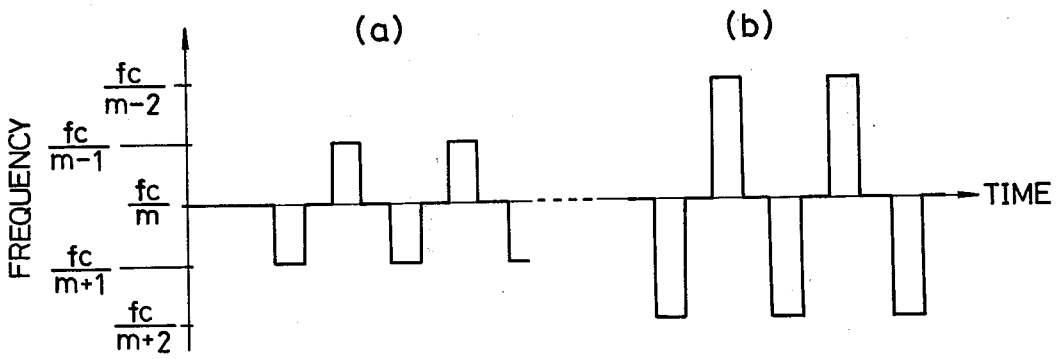
FIGS. 6(*a*) and 6(*b*) are graphs showing examples of adjustment of the vibrato depth in two different ways.

Selection of such vibrato depth is made by switches 58 and 59. The switches 58 and 59 are interlocked with each other. The sfirst state of connection of these switches 58 and 59 is a state shown in the figure in which a common line 53 is connected to the line 53b and a common line 55 to the line 55b. The second state of connection is a state in which the common line 53 is connected to the line 53a and the common line 55 to the line 55*a*. Accordingly, in the first state of connection, the frequencies $fc/m$, $fc/m + 1$, $fc/m$, $fc/m - 1$ are repeatedly produced from the output terminal 9, whereby a vibrato effect with a moderate vibrato depth as shown in FIG. 6(a) is obtained. In the second state of connection, frequencies $fc/m$, $fc/m + 2$, $fc/m$ $fc/m - 2$ are repeatedly produced from the output terminal 9, whereby a vibrato effect with a deep vibrato depth as shown in FIG. 6(*b*) is obtained.

If desired, various vibrato depths can be obtained by increasing the number of stages of the shift register 52 and thereby increasing the number of the delay steps.

Figure 7:
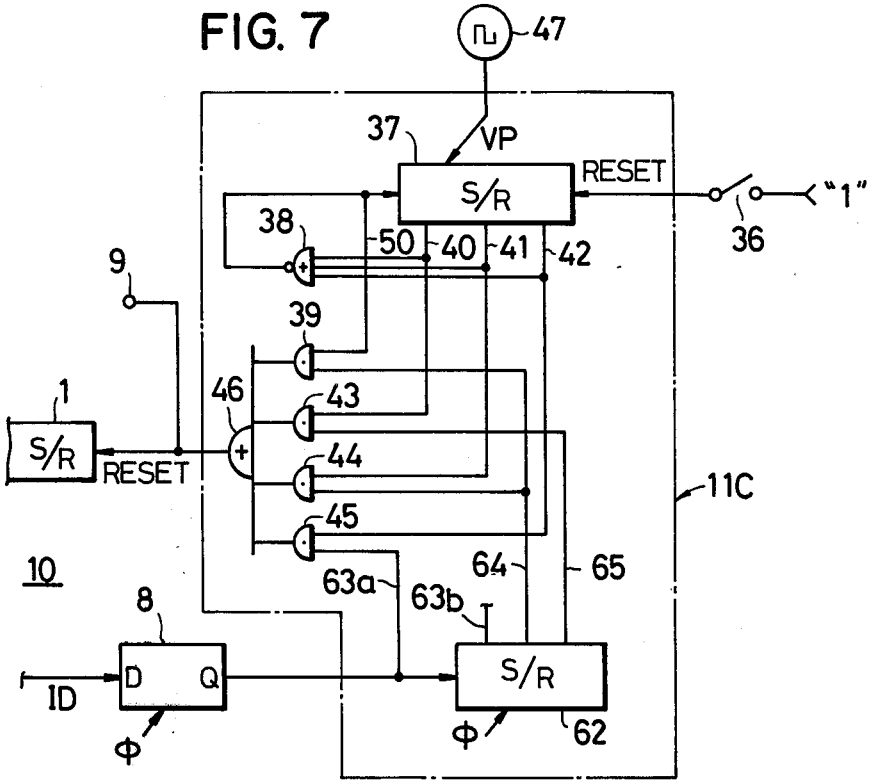
FIG. 7 is a block diagram showing another modified example of the pitch control device shown in FIG. 4 which is capable of producing the vibrato depth asymetrically with respect to frequency $fc/m$.

In the modified example shown in FIG. 7, a normal pitch of a tone selected by the keyboard switch circuit 5 is simulated by an average pitch perceptible to human hearing by imparting the vibrato depth asymmetrically with respect to the reference frequency. As in FIG. 5, a circuit portion related to a vibrato imparting circuit 11c only is shown in FIG. 7. The circuit portion illustration of which has been omitted is substantially the same as the corresponding circuit portion in FIG. 4. In the vibrato imparting circuit 11c of FIG. 7, the output of the delay flip-flop 8 is applied to a 3-bit shift register 62 and shifted therein in accordance with the master clock pulse $\phi$. Signals sequentially appear on an output line 63*a* of the delay flip-flop 8 and output lines 63*b*, 64 and 65 of the respective stages of the shift register 62 in turns with a delay of one bit time from each preceding signal. Assuming that the signals appearing on the lines 63*a*, 63*b*, 64 and 65 are used as the reset signal for the shift register 1 (FIG. 4), frequency dividing ratios are as shown in the following Table V, Column A and frequency divided outputs are as shown in Table V, Column B with the line 64 being taken as a reference frequency and under a condition $n + 3 = m$.

Table V

| reset signal | A frequency dividing ratio | n + 3 = m B frequency divided output |
|---|---|---|
| line 63a | $\frac{1}{n+1}$ | $\frac{fc}{m-2}$ |
| line 63b | $\frac{1}{n+2}$ | $\frac{fc}{m-1}$ |
| line 64 | $\frac{1}{n+3}$ | $\frac{fc}{m}$ |
| line 65 | $\frac{1}{n+4}$ | $\frac{fc}{m+1}$ |

In this embodiment also, the content of the read-only memory 6 is set in such a manner that a frequency divided output of a normal pitch of a tone selected by the keyboard switch circuit 5(FIG. 4) can be obtained when the signal on the line 64 is used as the reset signal for the shift register 1. However, the reference line 64 is not located in the middle of the plurality of steps of delay times but is deviated to the longer delay time 2 side (i.e. the side of the line 65). More specifically, difference in timing between the line 63*a* for the shortest delay time and the reference line 64 is two clock times, whereas difference in timing between the line 65 for the longest delay time and the reference line 64 is one clock time. As will be clear from the foregoing description, a shorter delay time results in a frequency divided output of a higher pitch and a longer delay time results in a frequency divided output of a lower pitch. Accordingly, as will be apparent from Table V, Column B in which the normal pitch corresponding to the line 64 is taken as reference, a high pitch corresponding to the line 64 has a greater amount of difference relative to the normal pitch than a low pitch corresponding to the line 65.

Figure 8:
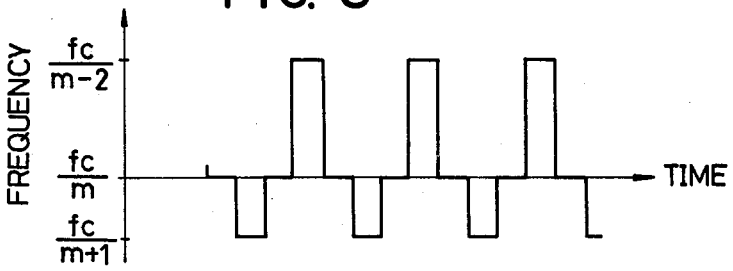
FIG. 8 is a graph showing an example of the vibrato depth which is asymmetrical with respect to frequency $fc/m$.

As shown in FIG. 7, a signal on the line 63*b* which is in a symmetrical relation in the delay time relative to a signal on the line 65 is not used but the line 63*a* is connected to AND circuit 45. The line 69 is connected to AND circuits 39 and 44, the line 65 to an AND circuit 43. In other words, the lines 63*a* and 65 which are in an asymmetrical relation to each other in the delay time are used with the line 64 being taken as the reference line. Accordingly, as the content of the shift register 37 is shifted in accordance with the vibrato clock pulse VP and the AND circuits 39, 43, 44 and 45 are thereby enabled in turns the line on which the reset signal for the shift register 1 appears cyclically changes in the order of the lines 64, 65, 64, 63*a* with the result that the frequency of the frequency divided output delivered out of the output terminal 9 changes in the order of $fc/m$ $fc/m+1$, $fc/m$, $fc/m-2$, returning to the initial frequency $fc/m$ and repeating the cycle. As shown in FIG. 8, the pitch above (i.e., higher than) the normal pitch $fc/m$ is large in the pitch difference whereas the pitch below (i.e., lower than) the normal pitch $fc/m$ is small in the pitch difference. Accordingly, a vibrato depth which is asymmetrical with respect to the normal pitch $fc/m$ is imparted. Such asymmetrical vibrato is adjusted by human hearing so that an average pitch of the pitches heard by the listener becomes the normal pitch $fc/m$.

The number of stages of the shift register 62 and difference between the upper limit delay time (corresponding to the line 65) and the lower limit delay time (corresponding to the line 63*a*) may be determined as desired. The vibrato depth may be variably adjusted by a switch or the like as in the example of FIG. 5. In this case, arrangements must be made so that difference between the shortest delay time and the reference delay time will become larger than difference between the longest delay time and the reference delay time. Such arrangements are obvious from the circuits shown in FIGS. 5 and 7 so that description thereof is omitted.

If the tone generator as shown in FIG. 4, 5 or 7 is provided for each note of the chromatic scale, vibrato which is different for each note can be imparted.

Figure 9:
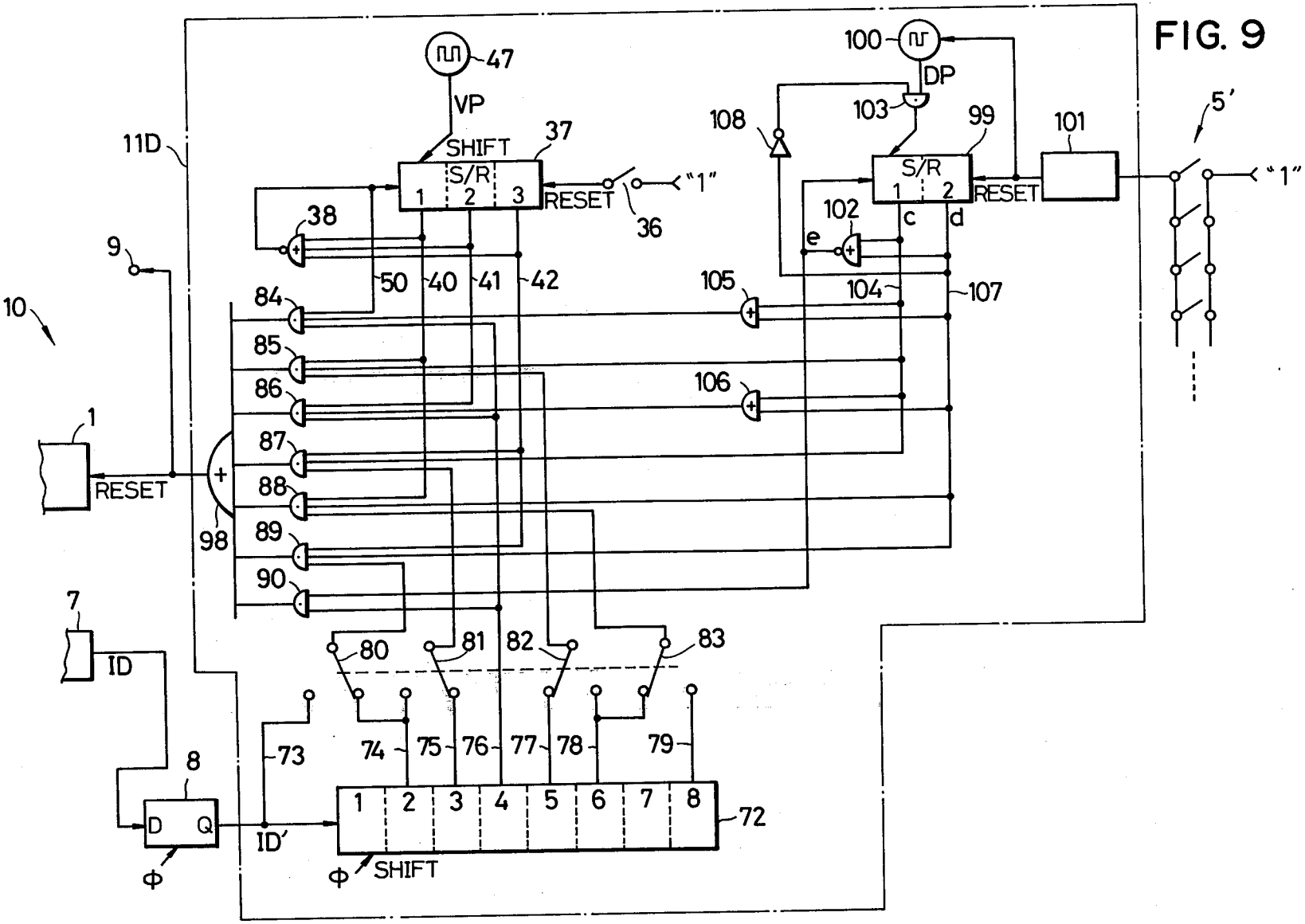
FIG. 9 is a block diagram showing still another embodiment of the pitch control device according to the invention which is capable of producing the delay vibrato effect according to which the vibrato depth gradually increases after depression of the key.

FIG. 9 shows still another embodiment of the tone generator according to the invention capable of imparting a delay vibrato effect. In FIG. 9, the component parts which are the same as those shown in FIG. 7 are designated by the same reference numerals. A delay vibrato imparting circuit 11D is inserted between the delay flip-flop 8 and the reset input of the shift register 1 for periodically delaying the reset timing of the shift register 1 in accordance with the vibrato frequency and also progressively increasing the delaying amount of the reset timing with the lapse of time after depression of a key.

A shift register 72 sequentially shifts the output of the delay flip-flop 8 at a rate of the master clock pulse $\phi$ and thereby delays the coincidence detection output ID of the comparator 7 (i.e., the output of the flip-flop 8) sequentially in several steps, producing delayed outputs with different delay times parallelly from the respective stages. A delay time from detection of coincidence in the comparator 7 till appearance of a delayed coincidence detection signal ID' (="1") aon an output line 73 is equivalent to one bit time of the master clock pulse $\phi$. A delay time from application of the delayed coincidence detection signal ID' to the shift register 72 till appearance thereof on an output line 74 of the second stage is three clock times (In the present embodiment, outputs of the first and seventh stages are not used.). Further, delayed outputs on lines 75, 76, 77 and 78 of the third through sixth stages have delay of four to seven clock times and an signal on an output line 79 of the eighth stage is delayed by nine clock times from the coincidence detection output ID. Assume that coincidence of the content of the shift register 1 with a digital numerical value read from the read-only memory 6 is detected by the comparator 7 when an shots of the master clock pulse $\phi$ counting from a state in which content of the shift register 1 (i.e. counter) is all "0" (i.e. the shift register 1 is reset) have been applied to the shift register 1. When $n+1$ shots of the pulse $\phi$ have been applied to the shift register 1, the output of the line 73 is "1". Likewise, $n+3$, $n+4$, $n+5$, $n+6$, $n+7$ and $n+9$ shots of the pulse $\phi$ have been respectively applied to the shift register 1, a signal "1" appears on lines 74, 75, 76, 77, 78 and 79 respectively. In the signal "1" on the line 73, 74, 75, 76, 77, 78 or 79 is used as the reset signal for the tone generator 10, the frequency dividing ratios are as shown in the following Table VI:

Table VI

| reset signal | A frequency dividing ratio | n + 5 = m B frequency divided output (Hz) |
|---|---|---|
| line 73 | $\frac{1}{n+1}$ | $\frac{f}{m-4}$ |
| line 74 | $\frac{1}{n+3}$ | $\frac{f}{m-2}$ |
| line 75 | $\frac{1}{n+4}$ | $\frac{f}{m-1}$ |
| line 76 | $\frac{1}{n+5}$ | $\frac{f}{m}$ |

Table VI-continued

| reset signal | A frequency dividing ratio | n + 5 = m B frequency divided output (Hz) |
|---|---|---|
| line 77 | $\frac{1}{n+6}$ | $\frac{f}{m+1}$ |
| line 78 | $\frac{1}{n+7}$ | $\frac{f}{m+2}$ |
| line 79 | $\frac{1}{n+9}$ | $\frac{f}{m+4}$ |

As will be apparent from Table VI, Column A, if the delay time of the signal used as the reset signal for the shift register 1 differs, the frequency dividing ratio will differ accordingly. If, for example, the frequency divided output produced when the delayed output on the line 76 is used as the reset signal for the shift register 1 is taken as the reference frequency $f/m$(where f represents frequency of the master clock pulse $\phi$ nand $m = n + 5$), frequency divided outputs obtained by using signals on the lines 73 - 79 as the reset signal are as shown in Table VI, Column B. The frequency divided ouput on the line 73, 74 or 75 is higher in frequency than the reference frequency on the line 76, whereas the frequency divided output on the line 77, 78 or 79 is lower in frequency than the reference frequency. The content of the digital numerical value read from the read-only memory 6 is set at a value defining the normal pitch of the reference frequency divided output $f/m$(Hz) selected by the keyboard switch circuit 5.

Vibrato depth setting switches 80, 81, 82 and 83 (FIG. 9) are provided for changing the degree of the vibrato depth as will be described in detail later. If these switches 80 - 83 are connected as illustrated in FIG. 9, the delayed outputs appearing on the output lines 74, 75, 76, 77 and 78 of the shift register 72 are supplied to AND circuits 84 - 90 and, when the AND circuits 84 - 90 are enabled, these signals are used as the reset signal for the shift register 1.

The shift register 37 sequentially produces a signal "1" on the output lines 40, 41, and 42 of the repective stages thereof and an output line 50 of ta NOR circuit 38 at a rate of the vibrato clock pulse VP. The signals on the lines 50 and 41 are resectively applied to the AND circuits 84 and 86 for selecting the reference delayed output line 76. The signal on the line 40 is applied to the AND circuits 85 and 88 for selecting the delayed output from the switch 82 or 83 which is of a later delay time than the signal on the reference line 76. The signal on the line 42 is applied to the AND circuits 87 and 89 for selecting the delayed output from the switch 80 or 81 which is of an earlier delay time than the signal on the reference line 76. Accordingly, as a signal "1" is sequentially and repetitively produced on the lines 50, 40, 41 and 42 at the rate of the vibrato clock pulse VP, the delayed outputs on the line 76, the line 77 or 78, the line 76, and the line 74 or 75 are cyclically selected by the AND circuits 84 - 89 and used as the reset signal for the shift register 1 through the OR circuit 98. As the delayed output line for supplying the delayed output used as the reset signal for the shift register 1 changes cyclically by the signal supplied through the lines 40 - 42 and 50, the frequency dividing ratio changes cyclically as shown in Table VI and the frequency divided output varies upwardly and downwardly with resepct to the normal pitch $f/m$ thereby producing the vibrato effect. The vibrato frequency is determined by the frequency of the vibrato clock pulse VP. In the case of the example shown in FIG. 9, the pitch changes four times during one vibrato cycle. If, accordingly, the vibrato frequency is set at 7 Hz, the frequency of the vibrato clock pulse VP should be set at 28 Hz.

The AND circuits 84 - 89 select the signals on the delayed output lines 73 - 79 upon receipt of the signals supplied on the lines 40 - 42 and 50 only when a signal "1" is applied to the third input of these AND circuits 84 - 89 from a shift register 99. The shift register 99 controls temporal change of the vibrato depth in the delay vibrato. The variation time of the vibrato depth is set by a depth variation time setting clock pulse DP.

Figure 10:
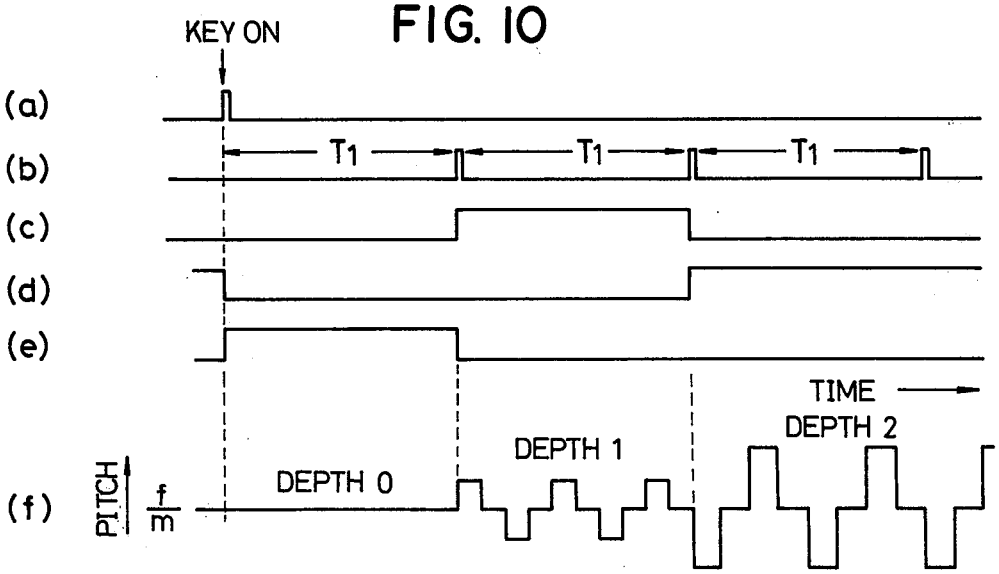
FIGS. 10(*a*) through 10(*e*) are timing charts for explaining the delay vibrato effect produced by the embodiment shown in FIG. 9.

When a key has been depressed on the keyboard, the shift register 99 is reset and a delay oscillator 100 starts its operation (or is reset) whereby the delay vibrato control is started. In a depressed key detection switch circuit 5', a plurality of switches are provided in such a manner that each of the switches corresponds to and interlocked with one of the switches in the keyboard switch circuit 5. Fixed contacts of these switches are commonly connected and so are movable contacts thereof. When the key is depressed, a signal "1" is applied to a differentiation circuit 101, Accordingly, a shot of pulse is produced by the differentiation circuit 101 immediately upon depression of the key. The shift register 99 is reset by the output pulse of the differentiation circuit 101 with all outputs of the respective stages of the shift register 99 becoming "0" (FIGS. 10 (*c*) and 10(*d*)). At this time, the output of the NOR circuit 1)2 becomes "1" (FIG. 10(*e*)) which enables the AND circuit 90. Since none of the AND circuits 84 - 89 is enabled, the signal on the reference delayed output line 76 connected to the AND circuit 90 only is used as the reset signal for the shift register 1. Accordingly, the frequency divided output delivered out of the output terminal 9 of the tone generator 10 maintains the normal pitch $f/m$(Hz) so that the normal pitch is maintained for same time after depression of the key as shown in FIG. 10(*f*) without being imparted with vibrato. The state in which no vibrato is imparted continues until a signal "1" is loaded in the first stage of the shift register 99.

Figure 11:
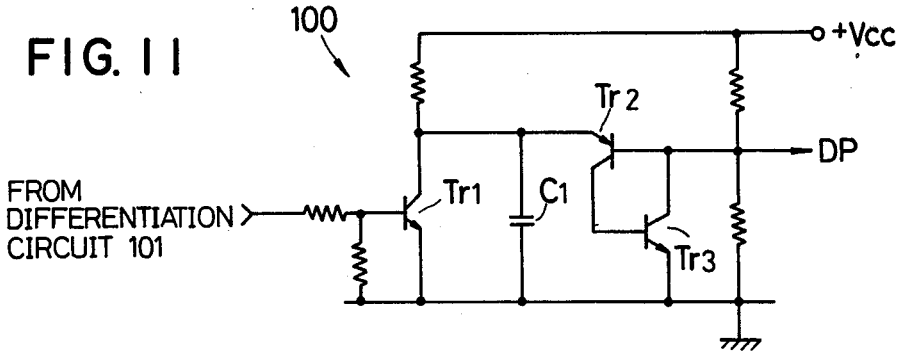
FIG. 11 is a circuit diagram showing a delay oscillator 100 of FIG. 10.

A delay oscillator 100 may be composed of transistors T*r*1, T*r*2 and T*r*3 and a capacitor C1 as shown in FIG. 11. As shown in FIG. 10(*a*), the delay oscillator 100 is reset upon receipt of one shot of pulse from the differentiation circuit 101. A pulse is delivered out of the collector of the transistor $Tr_3$ when time $T_1$ defining the oscillation period of the delay oscillator 100 has elapsed and subsequently the vibrato depth variation time setting pulse DP is generated at a constant interval of the time $T_1$ as shown in FIG. 10(*b*). The rate of the pulse DP is sufficiently lower than the rate of the vibrato clock pulse VP.

The first pulse DP generated by the oscillator 100 when the time $T_1$ has elapsed from start of depression of the key is applied to the shift clock input of the shift register 99 via an AND circuit 103. A signal "1" is loaded in the first stage of the shift register 99 by this first pulse DP. This causes a signal "1" to be produced on the output line 104 (FIG. 10(*c*)) and, as a result, the AND circuits 85 and 87 are enabled. The AND circuits 84 and 86 are also enabled through OR circuits 105 and 106. On the other hand, the output of the NOR circuit 102 becomes "0" which disenables the AND circuit 90. The delayed output lines to be selected from among the enabled AND circuits 84 - 87 are only the reference line 76 and the lines 75 and 77 (or 74 or 78) connected to the switches 81 and 82. Accordingly, as a signal "1" appears on the output lines 50, 40, 41 and 42 of the shift register 37 sequentially and repetitively in accordance with the vibrato clock pulse VP, the signal on the delayed output lines 76, 77, 76 and 75 is cyclically used as the reset signal for the shift register 1. In this case, as will be apparent from Table VI, the frequency divided output cyclically changes in pitch upwardly and downwardly in the order of $f/m, f/m + 1, f/m, f/m - 1$ then returning to the initial frequency f/m and repeating the same cycle thereafter. Thus, vibrato with "depth 1" shown in FIG. 10(*f*) is imparted to the generated tone. In FIG. 10(*f*), "depth 0" shows a state in which no vibrato is provided at all. The vibrato depth increases as the numeral designating the vibrato depth increases.

When the time $T_1$ has further elapsed, the second pulse DP is applied to the shift register 99 causing the signal "1" to be shifted to the second stage and thereby causing a signal "1" to be produced on the line 107 (FIG. 10(*d*)). Consequently, the AND circuits 84, 86, 88 and 89 are enabled while the other AND circuits 85, 87 and 90 are disenabled, with the result that the signals on the line 76 and the delayed output lines 74 and 78 (or 73 and 79) connected to the switches 80 and 83 only are used as the reset signal for the shift register 1. As a signal "1" is produces sequentially and repetitively on the output lines 50, 40, 41 and 42 of the shift register 37 in accordance with the vibrato clock pulse VP, the delayed outputs are produced on the delayed output lines 76, 78, 76 and 74 sequentially and repetitively for resetting the shift register 1. Accordingly, the frequency divided output of the tone generator 10 cyclically changes in pitch upwardly and downwardly in the order of $f/m, f/m + 2, f/m, f/m - 2$, then returning to the initial frequency f/m and repeating the same cycle thereafter, Thus, vibrato with "depth 2" as shown in FIG. 10(*f*) is imparted.

Assuming that vibrato having the deepest vibrato depth is one with "depth 2", the output of the second stage of the shift register 99 is inverted by an inverter 108 and thereafter is applied to the AND circuit 103. The AND circuit 103 therefore is disenabled and the pulse DP from the delay oscillator 100 is inhibited. The shift register 99 is not shifted thereafter and the signal "1" is held in the final stage (i.e. second stage) to maintain the deepest vibrato depth (i.e., depth 2). If release of vibrato is desired, the vibrato switch 36 is turned on to reset the shift register 37. This enables the AND circuit 84 only so that the frequency divided output of the normal pitch is maintained.

In the foregoing manner, the delayed vibrato whose vibrato depth progressively increases with the lapse of time after depression of the key can be achieved. If the number of stages of the shift registers 99 and 72 increases, a smoother delayed vibrato can be obtained.

The switches 80 - 83 provided for changing the degree of the vibrato depth are interlocked with each other and can be set at either one of two positions, i.e., a first position shown in FIG. 9 or a second position in which the switch 80 is connected to the line 73, the switch 81 to the line 74, the switch 82 to the line 78 and the switch 83 to the line 9, respectively. If the switches 80 - 83 are set at the second position, the pitch of the frequency divided output at "depth 1" in Table VI cyclically changes in the orders of $f/m, f/m + 2, f/m, f/m - 2$ with the result that the same depth of vibrato as in the case of "depth 2" in the first position is obtained. In "depth 2" in the first position is obtained. In "depth 2" of the second potition, the pitch cylically changes in the order of $f/m, f/m + 4, f/m, f/m - 4$ whereby a deeper vibrato is produced. Accordingly, the degree of the overall vibrato depth in the delay vibrato can be adjusted by changing over of the switches 80 - 83.

Figure 12:
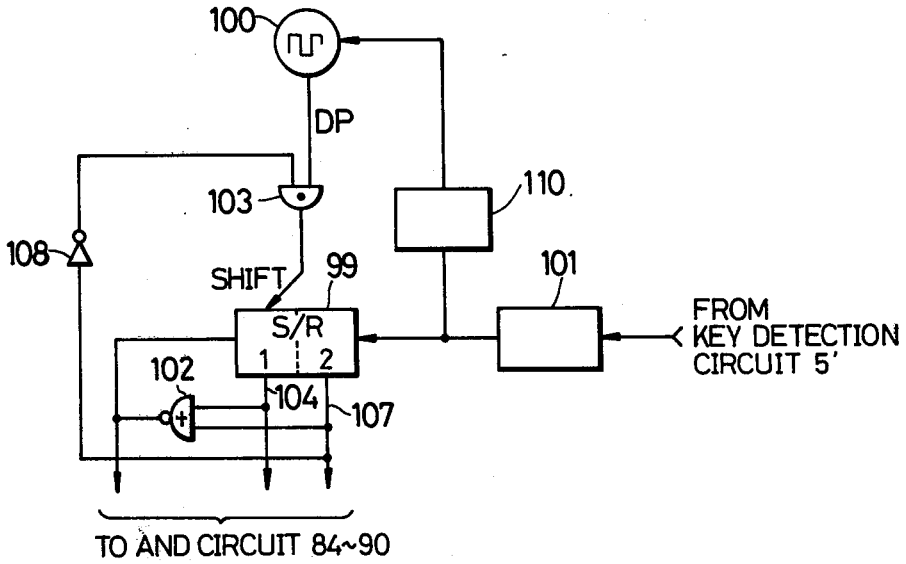
FIG. 12 is a block diagram showing a modified example of the embodiment of the pitch control device shown in FIG. 9.
Figure 13:
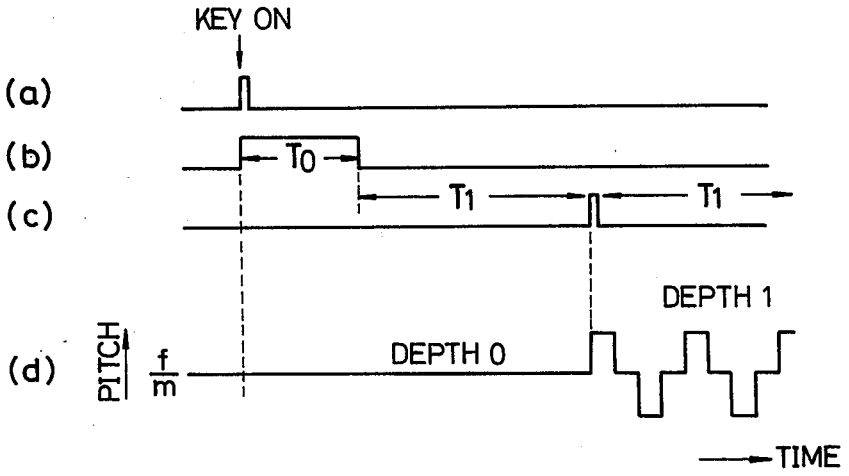
FIG. 13(*a*) through 13(*d*) are timing charts for explaining the delay vibrato control operation by the pitch control device shown in FIG. 12.

FIG. 12 shows a modified example of the delay vibrato imparting circuit of FIG. 9. In FIG. 12, a circuit portion about the shift register 99 only is illustrated and illustration of the reset of the circuit which is substantially the same as the one shown in FIG. 9 is omitted. The example shown in FIG. 12 is adatped to maintain a longer time of depth "0", i.e., a longer normal pitch time. For this purpose, one shot circuit 110 is inserted for delaying start of the operation of a delay oscillator 100 when one shot of pulse (FIG. 13(*a*)) produced by a differentiation circuit 101 upon depression of the key is applied to the delay oscillator 100. Since the delay oscillator 100 starts its operation when time $T_0$ set by the one shot circuit 110 has elapsed (FIG. 13(*c*)), time of "depth 0" during which no vibrato is produced becomes $T_0 + T_1$ and therefore is prolonged (FIG. 13(*e*)). A desirable delay vibrato effect can be produced by prolonging the time without vibratc in the initial stage of tone production as long as possible and imparting the progressively increasing vibrato concentrically in the ensuing time of the tone production. The operation time $T_0$ of the one shot circuit 110 can be determined as desired.

Figure 14:
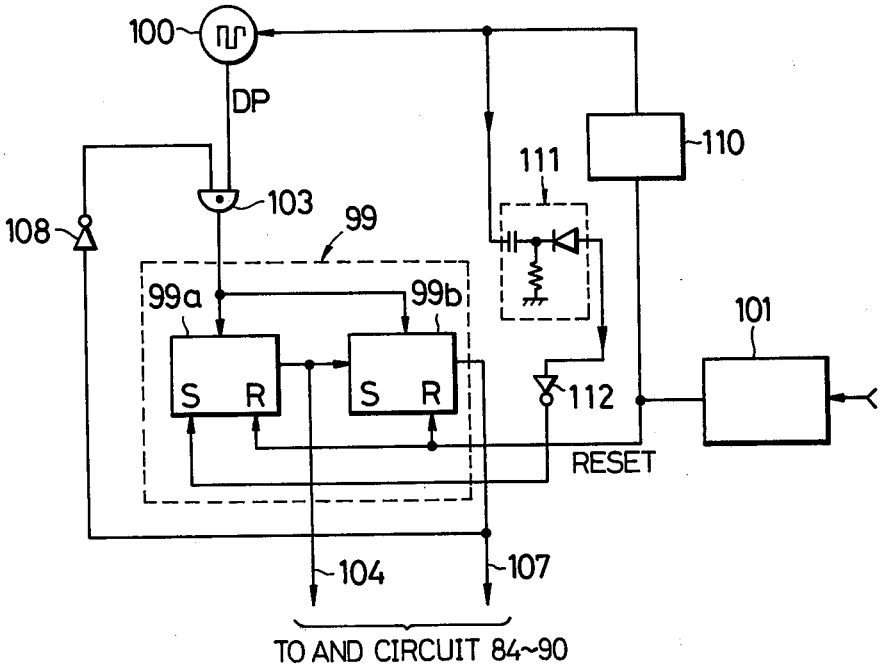
FIG. 14 is a block diagram showing another modified example of the pitch control device shown in FIG. 9.
Figure 15:
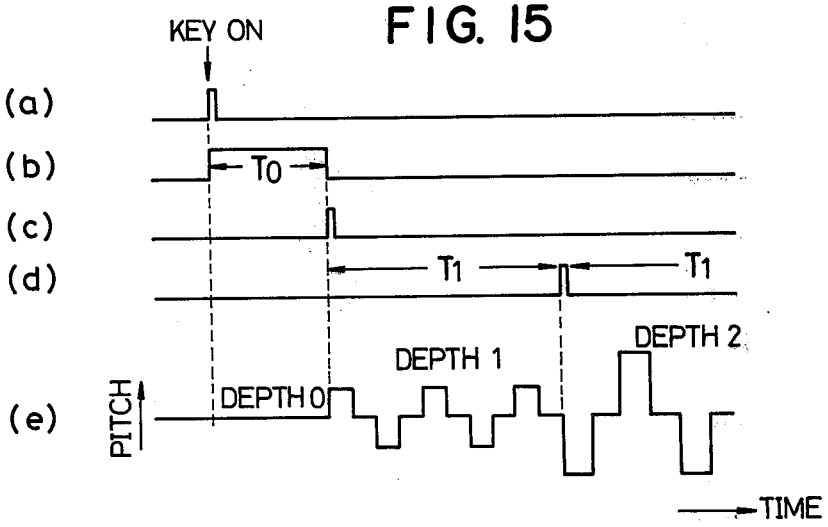
FIGS. 15(*a*) through 15(*f*) are timing charts for explaining the delay vibrato control operation by the pitch control device shown in FIG. 14.

FIG. 14 shows another example of the delay vibrato imparting circuit 11D. In FIG. 14 also, a circuit portion about the shift register 99 only is shown and the rest of the circuit which is the same as the one shown in FIG. 9 is omitted. In the example shown in FIG. 14, the holding time of "depth 0" depends entirely upon the operation time $T_0$ of the one shot circuit 110. One shot of pulse (FIG. 14(*a*)) outputted from the differentiation circuit 101 upon depression of the key drives the one shot circuit 110 thereby operating the delay oscillator 100 (FIG. 15(*d*)) when operation time $T_0$(FIG. 15(*b*)) has elapsed. The output of the one shot circuit 110 is also applied to a differentiation rectification circuit 111 to cause it to produce a negative pulse when the operation time $T_0$ has elapsed. The negative pulse is inverted by an inverter 112(FIG. 15(*e*)) and is used to set a flip-flop 99*a* of the first stage of the shift register 99. Accordingly, a signal on an output line 104 of the first stage of the shift register 99 becomes "1" when the operation Time $T_0$ of the one shot circuit 110 has elapsed whereby vibrato of "depth 1" as shown in FIG. 15(*e*) is produced. When time $T_1$ has elapsed after the operation time $T_0$, the oscillator 100 produces the pulse DP thereby causing the signal "1" of the flip-flop 99*a* of the first stage to be shifted to a flip-flop 99*b* of the second stage. Consequently, the vibrato depth is shifted to "depth 2". Incidentally, in the circuit shown in FIG. 14, the NOR circuit 102 is not provided. It will be understood from the above description that the holding time of "depth 0" during which no vibrato is imparted depends solely on the operation time $T_0$ of the one shot circuit 110 so that the holding time of "depth 0" can be set as desired by suitably setting the operation time $T_0$.

If it is desired to impart the delay vibrato effect separately for each tone of the twelve-tone scale, the tone generator 10 having the delay vibrato imparting circuit as shown in FIG. 9, 12 or 14 may be provided for each tone.

What is claimed is:

1. In a tone generator including a counting circuit for successively changing the content thereof in accordance with a clock pulse and a comparison circuit for comparing the content of the counting circuit with a set value for da depressed key to detect coincidence between the content and the set value, the coincidence detection output of said comparison circuit being utilized as a reset signal for resetting said counting circuit and an output pulse of a desired interval being produced at a timing of resetting of said counting circuit, the improvement which comprises:

first means for delaying the coincidence detection output of said comparison circuit sequentially and successively in a plurality of stages; and second means for selectively supplying a plurality of delayed outputs differing in delay time to said counting circuit as the reset signal;

the interval of said output pulse being changed by delaying the timing of resetting said counting circuit.

2. A tone generator is defined in claim 1 wherein said second means are a switching circuit selecting one of the plurality of delayed outputs.

3. A tone generator as defined in claim 1 wherein said second means cyclically and sequentially select the plurality of delayed outputs differing in delay time at a rate associated with a vibrato frequency and supply the selected delayed output to said counting circuit as the reset signal.

4. A tone generator as defined in claim 3 which further comprises means for selecting a single group corresponding to a desired vibrato depth from among groups of the delayed outputs of the respective stages provided by said first means to supply the selected group to said second means.

5. A tone generator as defined in claim 3 wherein difference between the earliest delay time and a reference delay time corresponding to a normal pitch is greater than difference between the last delay time and the reference delay time.

6. In a tone generator including a counting circuit for successively changing the content thereof in accordance with a clock pulse and a comparison circuit for comparing the content of the counting circuit with a set value for a depressed key to detect coincidence between the content and the set value, the coincidence detection output of said comparison circuit being utilized as a reset signal for resetting said counting circuit and an output pulse of a desired interval being produced at a timing of resetting of said counting circuit, the improvement which comprises:

first means for delaying the coincidence detection output of said comparison cirduit sequentially and successively in a plurality of stages to produce a plurality of delayed outputs differing in delay time;

second means for selecting, as signals for resetting said counting circuit, some of the delayed signals produced by said first means sequentially and cyclically at a rate associated with a vibrato frequency; and third means for designating the delayed signals to be selected by said second means in such a manner that a combination of the designated signals varies with the lapse of time after depression of the key;

whereby a vibrato effect changing in depth of vibrato with the lapse to time is produced.

* * * * *